US006589357B1

(12) United States Patent
Wandres

(10) Patent No.: US 6,589,357 B1
(45) Date of Patent: Jul. 8, 2003

(54) PROCESS AND APPARATUS FOR REMOVING IMPURITIES FROM SURFACES CONTAMINATED WITH LIQUID

(75) Inventor: Claus G Wandres, Stegen (DE)

(73) Assignee: Wandres GmbH Micro-Cleaning, Buchenbach-Wagensteig (DE)

( * ) Notice: Subject to any disclaimer, the term of this patent is extended or adjusted under 35 U.S.C. 154(b) by 212 days.

(21) Appl. No.: 09/711,995

(22) Filed: Nov. 14, 2000

(30) Foreign Application Priority Data

Nov. 15, 1999 (DE) ..... 199 55 066

(51) Int. Cl.[7] ..... B08B 1/00

(52) U.S. Cl. ..... 134/6; 134/2; 134/9; 134/10; 134/11; 134/12; 134/13; 134/15; 134/19; 134/30; 134/31; 134/32; 134/41; 15/21.1; 15/77; 15/88.2

(58) Field of Search ..... 134/2, 9, 10, 11, 134/12, 13, 15, 19, 31, 32, 41, 6, 30; 15/21.1, 77, 88.2

(56) References Cited

U.S. PATENT DOCUMENTS 4,817,652 A * 4/1989 Liu et al. ..... 134/102.1
5,502,881 A * 4/1996 Gaydoul ..... 134/122 R
5,507,876 A * 4/1996 Wandres ..... 134/9
5,879,465 A * 3/1999 McKevitt et al. ..... 134/15
6,029,681 A * 2/2000 Gaydoul et al. ..... 134/122 R

FOREIGN PATENT DOCUMENTS

| | | |
|---|---|---|
| DE | 3734236 A1 | 4/1989 |
| DE | 293278 | 8/1991 |
| DE | 0566831 A1 * | 10/1993 |
| DE | 1101542 A2 * | 5/2001 |
| EP | 0566831 | 2/1993 |
| JP | 6200388 | 7/1994 |

* cited by examiner

*Primary Examiner*—Sharidan Carrillo
(74) *Attorney, Agent, or Firm*—Volpe and Koenig, P.C.

(57) ABSTRACT

In order to remove impurities, especially liquids (5) and/or particles (4) from surfaces of plate-shaped workpieces (2) contaminated or wetted with liquid (5), at least one wiping element (3) is provided which moves with respect to the surface (2*a*) the wiping element (3) to be cleaned and contacts this surface (2*a*). The wiping element (3) is cooled down so that the liquid (5) coming into contact with this wiping element (3) and bristles (8) preferably provided thereon assumes a higher viscosity or even solidifies and consequently remains adhered together with the particles (4) contained in the liquid (5) to the wiping element (3) or its bristles (8). This cleaning principle can be assisted and influenced by heating of the surface of workpiece (2) upstream of the wiping element or elements (3) in the feed direction.

9 Claims, 3 Drawing Sheets

PROCESS AND APPARATUS FOR REMOVING IMPURITIES FROM SURFACES CONTAMINATED WITH LIQUID

BACKGROUND

The present invention concerns a process for removing impurities, particularly liquids and/or particles, from liquid-contaminated or wetted surfaces, and of especially plate-shaped workpieces, using at least one wiping element, in which a relative movement is carried out between the surface and the wiping element and the wiping element contacts the surface and/or the liquid layer forming or containing the impurities.

The present invention further concerns an apparatus for removing impurities, particularly liquids and/or particles, from liquid-contaminated or wetted surfaces, and especially plate-shaped workpieces, using at least one wiping element, in which a relative movement is permitted between the surface and the wiping element. The wiping element contacts the surface and/or the liquid forming or containing the impurities thereon. At least one endless rotating wiping element that is guided around reversing rollers is provided which includes a cleaning run for acting on the surface to be cleaned and a return run directed opposite to the cleaning run.

For example, in the automobile industry, but also in the manufacture of kitchen appliances, flat sheet or metal panels are shaped in stamping lines. For such shaping, it is advantageous if the panels exhibit a uniform or targeted lubrication of the surface, e.g., with oil. In addition, the surface should be as free as possible of foreign bodies, pile, fluff, grit, dust, and/or solid particles. Any foreign bodies or particles that may arise through production processes, for example, cutting processes or aligning or stacking processes, can be deposited on the surfaces of the panels leading to surface defects, scratches, pitting, etc., which are a problem especially after painting.

Especially as a result of increased use of galvanized-steel panels, stainless-steel panels, as well as aluminum panels, the damage to surfaces by particles or drawing defects as a result of improper oiling becomes more of a problem. In practice, dirty panels lead to refinishing in up to a quarter of the exterior body panels (for example, doors, roof, trunk, etc.) of a motor vehicle.

For the manufacturing process, there is thus the problem of having to clean such panels appropriately prior to feeding into stamping lines, be it in the automobile industry, in the manufacture of panels in the kitchen- and household-appliance industry, etc.

Until now it has been known to use washing machines working with water or wash oil and possibly high-pressure nozzles, in which it is possible to add detergents. This process can be supported by rotating brushes. Drying of the workpieces or panels proceeds with the aid of squeegee rolls or via blowing off of the surfaces. In addition, washing machines are known which operate exclusively with oil. These can be employed if oiling of the surface is necessary for the drawing process following the cleaning step.

On the whole, however, one is dealing in the case of these washing machines and washing units with expensive equipment. Beyond this, there is a problem with the disposal of the used wash water.

Rotating wiping elements with a cleaning run and a return run are known, for example, from DE 42 13 342 A1 or from DE 43 14 046 C2. Therein, processing of the surfaces proceeds in the dry state. Cleaning of a surface contaminated or wetted with liquid is hardly or only to a limited extent possible using the apparatus according to DE 42 13 342 A1.

DE 43 14 046 C2 describes a process for cleaning dry surfaces in which the wiping element is moistened. Both this process as well as the corresponding apparatus are thus not suited to cleaning surfaces contaminated or wetted with liquid.

The problem therefore exists to create a process and apparatus of the type mentioned above with which it is possible to remove particles from surfaces contaminated or wetted with liquid, while avoiding washing machines operating with water or oil.

SUMMARY

The process of the type mentioned above for solving this problem is surprisingly characterized by the fact that the wiping element or elements are cooled down with respect to the surroundings, the workpiece, and its contamination, and the surface to be cleaned is acted on by the comparatively cold wiping element or elements.

The present invention makes use of the fact that liquids are precipitated onto a cold surface as condensate or, at an appropriately low temperature of this surface, are even deposited as a solid. Thus, if one passes the cooled wiping element, e.g., a brush, over the surface contaminated or wetted with liquid, the moisture will become deposited on the wiping element given an appropriate temperature of the latter. In the case of the oils normally adhering to the workpieces to be cleaned, there is additionally the fact that their viscosity increases with decreasing temperature. Thus, there results a type of sticking effect between the cold wiping element and the liquid. The process according to the present invention can be appropriately influenced with regard to the applied temperature depending on whether one would like to remove more or less liquid from the surface. Above all, the particles located in a liquid film can also be deposited or "frozen" onto the wiping element such that these particles can be removed with correspondingly high certainty without it being necessary to include an expensive washing process using water or oil, which, for its part, would have to be cleaned away again.

An especially favorable and advantageous embodiment of the present invention is provided by the fact that at least the surface of the workpiece to be cleaned is heated up prior to contacting with the wiping element. Thus, there exists the possibility for modifying the cleaning process through temperature control. For example, a short-term rapid heating of the surface to be cleaned and possibly even to be dried can warm and even instantaneously heat the liquid adhering to this surface and thus reduce its viscosity. If such a thinned and heated liquid film meets up with the cooled and possibly extremely cold wiping element, the liquid freezes to the surface of the wiping element. As a result, dirt particles located in the liquid are also picked up and taken along by the wiping element. Appropriately thorough cleaning can be attained as a result.

One can attain a large temperature differential with correspondingly strong cleaning effect when the cleaning element is cooled down at least in the area acting on the surface to be cleaned almost to the solidification temperature, to the solidification temperature, or even below the solidification temperature of the liquid contaminating or wetting the surface being acted on.

This increases the effect of the liquid adhering or even "freezing" to the cleaning or wiping element.

It can be appropriate for the cleaning or wiping element to be cooled down such that it is about 10° C. or more, for example, on the order of magnitude of about 20° C. or more colder than the surface to be cleaned or the liquid wetting this surface. Tests have shown that a good cleaning effect is attained at such a temperature differential.

Embodiments of the process according to the present invention are contained in claims 5–10.

Claim 5 specifies, for example, an advantageous technique concerning the movement of the workpiece and its heating up as well as the contact with the cold wiping element after the point of heating.

Claim 6 contains an expedient contacting of the workpiece with the wiping element perpendicular to the direction of feeding of the workpiece.

Claim 7 concerns the removal of impurities picked up by the wiping element, which can advantageously occur outside the cleaning area.

Claim 8 contains an especially favorable embodiment of the process according to the present invention to the effect that following the cleaning process, a wetting liquid, for example, an oil can again be applied via the wiping element provided for cleaning to the cleaned workpiece so that the latter is well prepared for a subsequent shaping or stamping process and/or the wiping element is nicely conditioned for good pickup of further particles.

Claim 9 provides appropriate procedures for cleaning the wiping element.

Claim 10 contains a possible embodiment of the process in which the heat arising during refrigeration can be utilized in the cleaning process according to the present invention, namely, at least partially in heating up the surface to be cleaned before contacting the surface, viewed in its feeding direction, with the wiping element.

Above all, upon combination of a few or several of the above-described process features and measures, a cleaning of surfaces contaminated or wetted with liquid and particles contained therein is obtained, without the need for expensive washing and rinsing processes as well as the corresponding equipment investment and additional costs for detergent and disposal of wash water.

The above-mentioned apparatus for carrying out the process is, in solving the posed problem, characterized by the fact that it exhibits a cooling device for cooling down at least the cleaning run. Thus, in the above-mentioned apparatus, a cooling device or refrigerator is installed which cools down at least the cleaning run of the wiping element in suitable fashion so that this element can provide for an appropriate increase in the viscosity of the liquid located on the surface and can take along this liquid together with the particles contained therein.

Here, it is expedient if a feeding device is provided for a plate-shaped workpiece and the cleaning or wiping element or elements are positioned to act perpendicularly to the feeding direction. As a result, the desired relative movement between workpiece and wiping elements can be attained in simple fashion so that especially the workpiece can best follow the overall tempo of the production line and still be cleaned prior to its actual processing. In addition, the dirt picked up by the wiping elements can be moved in this manner away from the workpiece off to the side.

The wiping element or elements can be positioned in a refrigerated tunnel serving to cool down at least the cleaning run, the tunnel being open toward the surface to be cleaned. Such a refrigerated tunnel, in which a considerably reduced temperature thus prevails, can cool down the wiping element or at least its cleaning run in the desired fashion without adversely affecting accessibility to the surface to be cleaned.

It is especially favorable if the cooling device, appropriately the refrigerated tunnel mentioned above, also surrounds or acts on the wiping element at least over a portion of its return run. In this way, still more heat can be removed from the rotating wiping element. In addition, the cold can be more effectively employed in such a design, and the danger that, for example, warm air will be carried by the wiping element, itself, into the cooling device can be reduced.

A heating device for the surface to be cleaned, for example, a channel running perpendicular to the feeding direction and incorporating at least one heat source such as a quartz lamp, heating rods, gas flame, or the like can be positioned ahead of the cooling device in the feeding direction, and the heater or heating device and the cooling device or refrigerated tunnel can be positioned one right after the other in the feed direction. In this way, one can carry out appropriate heating up of the liquid wetting the surface of the workpiece to be cleaned or heating up of this surface immediately prior to contact with the cold wiping element. A heating up of the entire workpiece can be avoided since it is only important that the portion of the surface to be cleaned which is directly acted on by the wiping element be appropriately warmed or heated just prior to the wiping action.

One can provide as wiping element one or more linear brushes such as are known, for example, from DE 43 14 046 C2 (FIG. 3), and in the area outside of that travelled by the workpiece, cleaning devices, for example, doctor blades, at least one heating device, and/or blowing nozzles can act on the wiping element such that the previously picked-up impurities can be removed again in this area. Here, a heating device can reliquefy the previously picked-up and frozen liquid so that it can be more readily doctored, centrifuged, and blown off.

In the direction of rotation of the wiping element, behind the cleaning area, thus suitably on its return run, one can position at least one apparatus for wetting the wiping element, especially the bristles, with a liquid, for example, a lubricating liquid such as oil or the like. In this way, a cleaned surface can be simultaneously intentionally oiled again by the cleaning element either in order to be able to carry out another cleaning step including the already mentioned cooling down at a subsequent cleaning or wiping element in the feeding direction (in order to be able to remove all of the previously present particles with still greater reliability) or in order to prepare the workpiece for a shaping process. The capacity of a single wiping element or an initial wiping element in the feeding direction for picking up the particles to be removed can also be improved through such wetting.

Especially upon use of several successive wiping elements in the feed direction, these elements can have opposing wiping directions. In addition, the wiping elements can also be formed by tiles. The picked-up liquid, usually oil, can be reused following cleaning of the wiping element or elements. For example, this liquid, following appropriate filtering, could be fed back to an oiling device used in preparing panels for shaping or drawing.

BRIEF DESCRIPTION OF THE DRAWINGS

An embodiment of the present invention is described in more detail below based on the attached drawings. These include, as highly schematic representations.

DETAILED DESCRIPTION OF THE PREFERRED EMBODIMENTS

Figure 1:
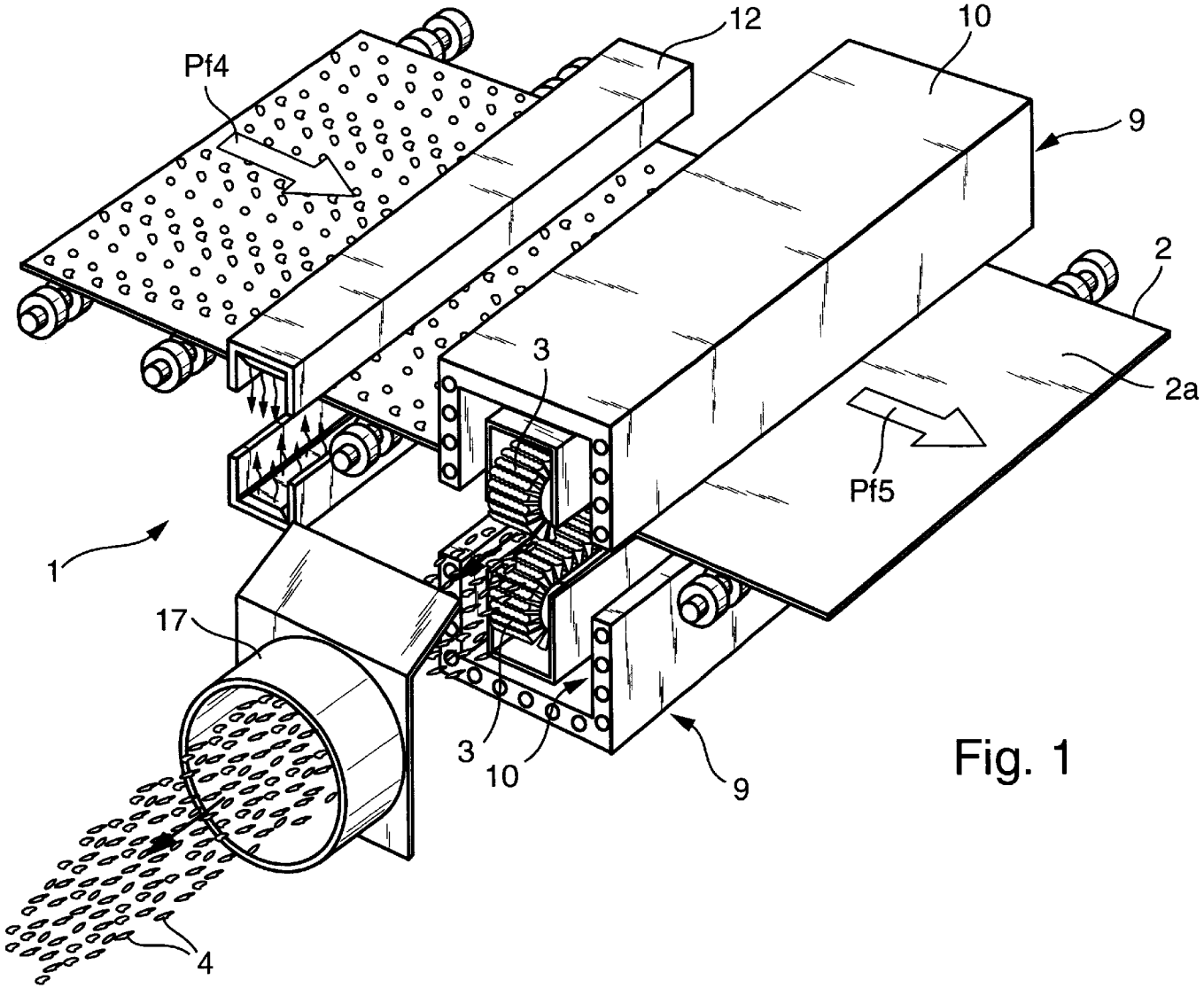
FIG. 1 is a graphic representation of an apparatus according to the present invention for removal of impurities from the two surfaces of a plate-shaped workpiece contaminated or wetted with liquid with the aid of a wiper element acting on each of these surfaces and located in a cooling device or refrigerated tunnel, and a heater or heating device for heating up the surfaces of the workpiece being positioned ahead of the wiping elements in the feed direction.
Figure 3:
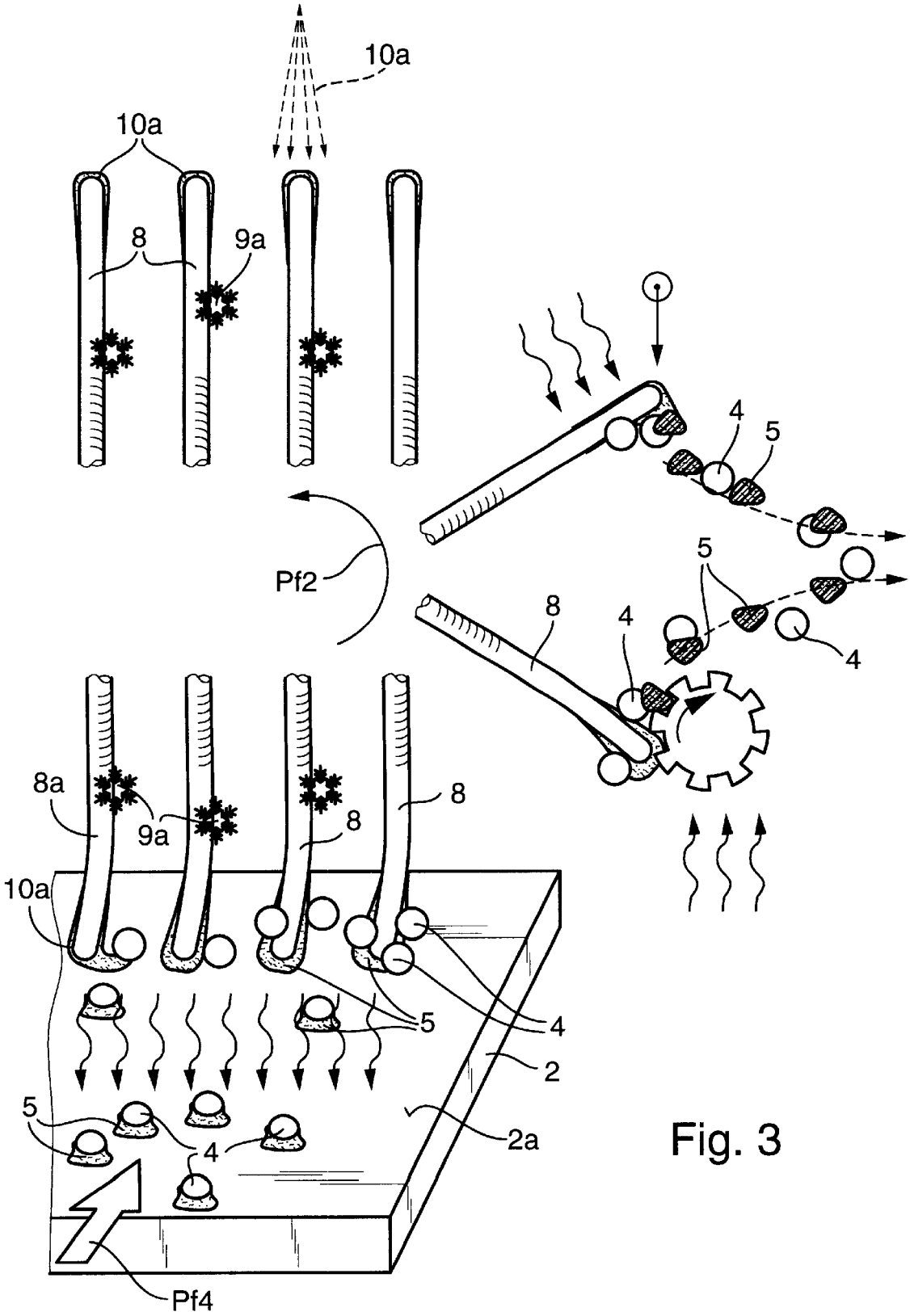
FIG. 3 is a greatly enlarged view illustrating the principle of the initial heating, the subsequent contacting of the surface of a workpiece with the cold bristles of an appropriately chilled wiping element, the subsequent cleaning of the wiping element, and its renewed wetting, possibly again in the cold state in order to enhance the pickup of particles during the cleaning process and/or in order to wet the surface to be cleaned with a liquid appropriate for further processing.

The apparatus schematically represented in FIG. 1 and designated as a whole with 1 serves in the removal of impurities, namely the liquids and particles schematically indicated in FIG. 3, from the surfaces of a plate-shaped workpiece 2 contaminated or wetted therewith. The apparatus 1 is suitable and designed for cleaning both of the large-area surfaces of such a plate-shaped workpiece 2 in a manner still to be described, namely the top side 2*a* shown in FIG. 1 and the bottom side parallel thereto.

The apparatus 1 includes at least one wiping element 3, which can act on the corresponding surface to be cleaned. Since, in the embodiment shown, both surfaces of a plate-shaped workpiece 2 are to be cleaned simultaneously, two parallel wiping elements 3 are accordingly provided which, in each case, carry out a relative movement with respect to the workpiece 2, and contact the surface or the liquid layer forming and containing the impurities, which is indicated schematically also in FIG. 3 for a top surface 2*a*. Here, the particles 4 are represented schematically on liquid 5, without illustrating a total wetting of the surface 2*a*.

The provided wiping elements 3 are guided in each case around reversing rollers 11 and designed as endless wiping elements 3 rotating in the direction of arrows PF1, PF2, PF3. Accordingly, the wiping elements 3 have a workpiece processing cleaning run 6 for acting on the surface 2*a* to be cleaned and a return run 7 moving oppositely to the cleaning run 6.

In order that the wiping element 3 can pick up the particles 4 and liquid 5 with the bristles 8 provided over its cleaning run 6 and transport them away from surface 2*a*, apparatus 1 includes a cooling device 9 at least for this cleaning run 6, and preferably as in the illustrated embodiment, for the entire wiping element 3. Thus, the wiping element 3 and especially its cleaning run 6 as well as the bristles 8 provided there can be considerably cooled down compared to the surroundings and thus also compared to the surface 2*a* of the workpiece 2 and compared to the impurities adhering thereto, namely liquid 5 and the particles 4, which, as concerns liquid 5, leads to the fact that it adheres to the wiping element 3 or its bristles 8 through the sudden increase in viscosity and, thereby, also leads to sticking of particles 4, as is shown schematically in FIG. 3.

The greater coldness of the bristles 8 of the wiping element 3 shown is indicated schematically by water crystals 9*a*, although, naturally, no such traces of water are provided on these bristles 8.

FIG. 3 illustrates that the bristles somewhat wetted in a manner still to be described can, due to their coldness, tightly secure a liquid 10*a* wetting them due to its reduced viscosity so that the liquid 5 located on the surface 2*a* of the workpiece 2 (as can be easily recognized in the case of the four bristles 8 shown in contact with this surface 2*a*) can readily adsorb so that this liquid 5, too, "freezes" to the bristles 8 and thereby takes along particles 4. The bristle 8*a* shown to the bottom left in FIG. 3 is just beginning to pick up liquid 5. The neighboring bristle has already gripped, in addition to the liquid 10*a* originally adhering to it, a portion of liquid 5 and is also picking up a particle 4. In contrast, the third bristle from the left carries liquid and particles, and the liquid 5 and several particles 4 adhere to the bristle 8 shown to the bottom right in FIG. 3 and can be transported away. The adhesion is favored here by the coldness of bristles 8.

Apparatus 1 includes a feeding mechanism (not shown in detail) for the plate-shaped workpiece 2, which, however, is indicated by the fact that the feeding direction and movement of the workpiece 2 are indicated in FIG. 1 by arrows PF4 (region still soiled) and PF5 (cleaned area of workpiece 2). It becomes simultaneously clear here that the cleaning or wiping elements 3 are positioned to act and wipe perpendicularly to this feeding direction. According to FIG. 2, the cleaning run 6 of wiping element 3 moves according to arrow PF1 at a right angle to arrow PF4 also included in FIG. 2.

Provided as the cooling device 9 for each wiping element 3 in the present embodiment is a refrigerated tunnel 10, which accommodates not only the cleaning run 6 but also the return run 7, i.e., practically the entire wiping element 3, but is open toward the surface 2*a* to be cleaned so that the cleaning run 6 can reach this surface. Only in the end region, where the wiping element is guided around a reversing roller 11, can the cooling device 9 or refrigerated tunnel 10 be open or enlarged such that cleaning of the wiping element 3 can take place there in the manner to be described on the basis of FIGS. 2 and 3. The cooling device 9 thus surrounds and acts on its associated wiping element 3 over at least portions of its return run 7, as well, so that a correspondingly good cooling down can be attained.

Ahead of this cooling device 9 in the direction of feeding of the workpiece 2, one recognizes in FIG. 1 in schematic form a heating device 12 for the surface 2*a* to be cleaned, such a heating device 12 being provided in the present embodiment for both surfaces of workpiece 2, i.e., for the top side 2*a* and the opposing bottom side. Each heating device 12 is designed as a channel running across the feeding direction and provided with at least one heating source such as a quartz lamp, heating rods, gas flame, or the like, which will not be described in more detail herein. Here, this heater or heating device 12 and the cooling device 9 or refrigerated tunnel 10 are arranged one right behind the other in the feed direction so that just prior to contacting of the surface to be cleaned with the wiping element 3, at least liquid 5 adhering to the surface and containing the particles 4 becomes heated, with a resulting reduction in the viscosity of this liquid so that, as a result of the sudden cooling down upon contact with the wiping element 3 and its bristles 8, a considerable amount of liquid becomes fixed on the wiping element 3 along with the particles 4.

The short distance between the heating device 12 and the cooling device 9 saves energy since the entire workpiece 2 does not need to be heated, but rather only the immediate surface or its contamination.

It was already mentioned that in the present embodiment, a wiping element with bristles 8 is provided, i.e., linear brushes are provided as the wiping element 3 such as are also described, for example, in German Patent publication 43 14 046, one being able to select a spatial arrangement similar to that used in this known device.

Figure 2:
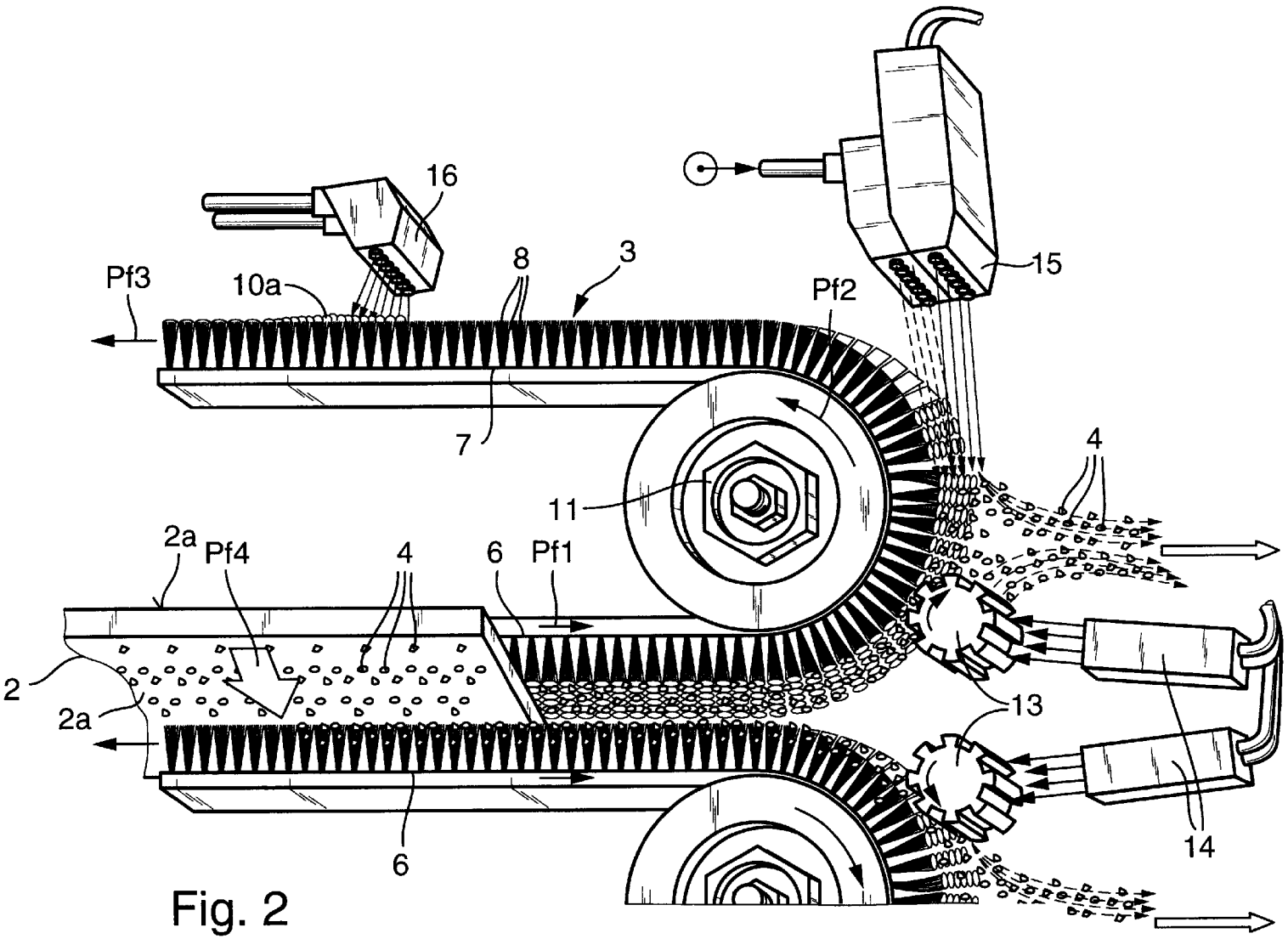
FIG. 2 shows, in particular, the parts of the wiper elements located outside the cleaning area, with the cleaning devices positioned there, through which the impurities picked up by the wiping elements can be removed from them.

In the area outside that in which the workpiece 2 runs, the cleaning devices indicated in FIGS. 2 and 3 (in the present embodiment, rotating doctor blades 13) with their associated heating devices 14 act on the wiping elements 3. In addition, a hot-air blower 15 is provided so that liquid 5 with the particles 4, adhering due to their coldness, can be appropriately loosened and thrown off also as a result of the centrifugal force in the reversing area of the wiping element 3 and additionally blown away and/or suctioned off.

Also shown behind the cleaning area of wiping element 3 in the direction of rotation according to arrow PF3, i.e., behind the reversing roller 11, is an apparatus 16 for wetting the wiping element 3 and its bristles 8 with the already mentioned liquid 10*a*, for example, a lubricating liquid such as oil or the like. As a result, the bristles 8 are better prepared in the manner already described to pick up the particles 4 as well as liquid 5 in the chilled state because adhesion to the bristles 8 is improved. In addition, the workpiece 2 can be provided in this way with a thin liquid or oil film, which is advantageous or even necessary for later shaping through drawing or stamping. A device 16, designed as a sprayer, can also be employed here such that, above all, the—viewed in the panel feed direction—rear (discharge side) brushes or wiper elements 3 are sprayed especially heavily with the sprayer in order to attain renewed lubrication of the already cleaned surface, it being advantageous if several, for example, eight wiping elements 3 are positioned one after the other in the direction of feeding of the panel or workpiece 2.

Apparatus 1 thus serves in the removal of impurities, namely liquids 5 and/or particles 4, from surfaces 2*a* of plate-shaped workpieces 2 contaminated or wetted with such liquids 5 using at least one wiping element 3. Here, a relative movement is carried out between the surface 2*a* and the wiping element 3 in which the wiping element 3 contacts the surface 2*a* and the liquid layer forming or containing the impurities, which is illustrated schematically especially in FIG. 3. The wiping element 3 is cooled down compared to the workpiece 2 and its contamination, and the surface 2*a* to be cleaned is thus acted on by the relatively cold wiping element 3 such that liquid 5 located at the surface 2*a* of workpiece 2 solidifies and adheres correspondingly well to the wiping element 3, i.e., can be carried off from the surface 2*a*.

This effect can be improved through the fact that at least the surface 2*a* of the workpiece 2 to be cleaned or its contamination is heated by the heating device 12 prior to contact with the wiping element 3. As a result, the viscosity of liquid 5 is temporarily lowered so that it can be relatively easily deposited on the bristles 8 of the wiping element 3 and can then be fixed there due to the coldness.

At the same time, the cleaning element 3, at least in the area acting on the surface 2*a* to be cleaned, can be cooled down almost to the solidification temperature, to the solidification temperature, or even below the solidification temperature of the liquid contaminating or wetting the surface 2*a* to be cleaned. This initially warmer liquid adheres all the better to the cold wiping element 3. For example, the cleaning or wiping element 3 can be at least 10° C., preferably even more, for example, on the order of magnitude of 20° C. colder than the surface 2*a* to be cleaned. The greater the temperature differential, the better the initially warmer liquid adheres to the considerably colder wiping element 3. In this manner, the particles 4 located in liquid 5 are also grabbed and adhere, as tests have shown, to the cold wiping element 3 or its bristles 8, the liquid 5 taken up by the bristles or an already previously applied liquid 10*a* acting practically as a "glue" for these particles 4.

The workpiece 2 can be advantageously moved forward during its cleaning, it being first heated, viewed in the feeding direction, and then contacted by the cold wiping element 3. This permits a simple construction and arrangement of the heating device 12, on the one hand, and the cooling device 9 for the wiping element or elements 3, on the other. Here, one can select the proven arrangement in which the wiping element or elements 3 act on workpiece 2 perpendicularly or at a right angle to the latter's feed direction so that the picked-up impurities 4 and 5 can be carried away laterally from the workpiece 2 and its feed direction, as is also indicated in FIG. 1 by an exhaust pipe connection 17 of the apparatus 1. The wiping elements 3 moved continuously relative to the surface to be cleaned are thus freed and cleaned of picked-up liquid 5 and picked-up particles 4 outside the cleaning area. After cleaning, the linear brushes appropriately provided as the wiping element and their bristles 8 can again be wetted with a liquid 10*a*, for example, an oil, which liquid 10*a*, upon cooling down, can be brought to the reduced wiping temperature and thus to an increased viscosity so that it obtains an increased pickup capacity for particles 4 as well as for liquid 5 located on surface 2*a*. For cleaning, the wiping elements 3 are acted on mechanically and/or with heat and/or with forced air, as was already explained on the basis of FIGS. 2 and 3.

It should further be mentioned that the heat arising during the refrigeration used in cooling down the wiping element or elements 3 can be at least partially employed in heating up the surface 2*a* to be cleaned prior to contact with the wiping element or elements 3 (viewed in the feed direction) in order to obtain an operation incorporating maximum energy efficiency. In addition to the blowing off of the impurities to be eliminated from each wiping element 3, a suctioning off can also occur.

The process can advantageously be carried out continuously on moving workpieces 2 or even on endless material. Depending on the quality of the liquid 5 removed from surface 2*a*, the removed liquid—especially after filtration—can be fed back to an oiling device and produce, for example, uniform lubrication of workpieces 2 prior to a drawing process.

For example, when used with robots, three-dimensional or multiply curved surfaces can be nicely cleaned using the process of the present invention.

In order to remove impurities, especially liquids 5 and/or particles 4 from surfaces of workpieces 2 contaminated or wetted with liquid 5 using at least one wiping element 3, the wiping element 3, which moves with respect to the surface 2*a* to be cleaned and contacts this surface 2*a*, is cooled down so that the liquid 5 coming into contact with this wiping element 3 and bristles 8 preferably provided thereon assumes a higher viscosity or even solidifies and consequently remains adhering together with particles 4 contained in liquid 5 to the wiping element 3 or its bristles 8. This cleaning principle can be assisted and influenced by heating of the surface of workpiece 2 ahead of the wiping element or elements 3 viewed in the feed direction.

What is claimed is:

1. A process for removing impurities, including at least one of a liquid and particles from a liquid contaminated surface of a workpiece, comprising: providing at least one wiping element, cooling down the at least one wiping element, prior to contacting the surface of the workpiece, to about 10° C. or more cooler than the surface of the workpiece or about 10° C. or more cooler than the liquid on the surface, and contacting at least the liquid on surface of the workpiece with the cooled wiping element such that at least the liquid or the particles present on the surface of the workpiece are removed from the surface by the cooled wiping element.

2. The process according to claim 1, wherein the at least one wiping element is cooled down to about the solidification temperature, or below the solidification temperature of the liquid on the surface of the workpiece.

3. The process according to claim 1, further comprising heating up at least the surface of the workpiece to be cleaned prior to contact with the cooled wiping element.

4. The process according to claim 1, further comprising moving the workpiece forward during cleaning, and first heating the workpiece prior to contact by the cooled wiping element.

5. The process according to claim 1, wherein the at least one wiping element acts perpendicularly to a feed direction of the workpiece, and picked-up impurities are carried laterally away from the workpiece and the feed direction.

6. The process according to claim 1, further comprising continuously moving the at least one wiping element relative to the surface of the workpiece to be cleaned, and removing at least the liquid or the particles from the cooled wiping element, wherein the removing step occurs away from the surface of the workpiece.

7. The process according to claim 1, further comprising heating up the surface to be cleaned prior to contact with the cooled wiping element using heat arising from a refrigeration device used in cooling down the wiping element.

8. The process according to claim 6, wherein the at least one wiping element includes bristles on a rotating linear brush having an upper run and a lower run, further comprising the step of wetting the bristles with a wetting liquid after the removing of at least the liquid or the particles, such that the wetting liquid acquires an increased viscosity upon further cooling of the wiping element.

9. The process according to one of claim 6, wherein the at least one wiping element is at least one of acted on mechanically, acted on with heat, or acted on with forced air for removing at least the liquid or the particles from the wiping element.

* * * * *